US007823658B2

(12) United States Patent
Hartmann et al.

(10) Patent No.: US 7,823,658 B2
(45) Date of Patent: Nov. 2, 2010

(54) ANALYZING RESISTIVITY IMAGES FOR DETERMINING DOWNHOLE EVENTS AND REMOVING IMAGE ARTIFACTS

(75) Inventors: Andreas Hartmann, Niedersachsen (DE); Christian Fulda, Lower Saxony (DE); Dmitriy Dashevskiy, Nienhagen (DE); Stephan Dankers, Wunstorf (DE)

(73) Assignee: Baker Hughes Incorporated, Houston, TX (US)

( * ) Notice: Subject to any disclaimer, the term of this patent is extended or adjusted under 35 U.S.C. 154(b) by 96 days.

(21) Appl. No.: 12/118,350

(22) Filed: May 9, 2008

(65) Prior Publication Data

US 2009/0277686 A1 Nov. 12, 2009

(51) Int. Cl.
*E21B 44/00* (2006.01)

(52) U.S. Cl. ..... 175/57; 175/45; 175/40; 73/152.48; 73/862.392

(58) Field of Classification Search ..... 175/57, 175/45, 40; 73/152.48, 152.49, 862.392
See application file for complete search history.

(56) References Cited

U.S. PATENT DOCUMENTS 4,756,188 A * 7/1988 Fennell ..... 73/152.49
4,976,143 A * 12/1990 Casso ..... 73/152.45
5,581,024 A 12/1996 Meyer, Jr. et al.
6,088,294 A 7/2000 Leggett, III et al.
6,344,746 B1 2/2002 Chunduru et al.
6,760,665 B1 * 7/2004 Francis ..... 702/6
6,769,497 B2 8/2004 Dubinsky et al.
7,142,985 B2 11/2006 Edwards
7,195,062 B2 3/2007 Cairns et al.

FOREIGN PATENT DOCUMENTS

WO WO2005033473 A1 4/2005

* cited by examiner

*Primary Examiner*—Shane Bomar
(74) *Attorney, Agent, or Firm*—Mossman Kumar & Tyler PC

(57) ABSTRACT

Borehole images obtained with MWD measurements have a mismatch with subsequent images obtained when measurements are repeated over the same depth interval after the drillstring has been raised up. The difference is attributable to stretch of the drillstring. This can be estimated by correlating the two images. The difference can also be estimated by monitoring drilling conditions such as RPM, WOB and torque on reentry.

18 Claims, 7 Drawing Sheets

ANALYZING RESISTIVITY IMAGES FOR DETERMINING DOWNHOLE EVENTS AND REMOVING IMAGE ARTIFACTS

BACKGROUND OF THE DISCLOSURE

1. Field of the Disclosure

This disclosure is related to methods for determining the depth of a drillbit and using the determined depth for controlling the operation of downhole logging tools. The method of the disclosure is applicable for use with both measurement-while-drilling (MWD) tools and wireline tools.

2. Description of the Related Art

During the drilling of a hydrocarbon wellbore, surface measurements are commonly made of the amount of drillstring conveyed into the earth as a measure of the length of the drillstring in the borehole. This length is used to estimate the measured depth (or along hole length) of a borehole. Discrepancies in the length of the borehole estimated at the surface and the actual length of the borehole can result in misalignments of logs of data measured with sensors on the drillstring. One common cause of this discrepancy is an assumption that the drillstring is inelastic and therefore does not stretch.

WO2005033473 of Aldred et al. addresses this problem using a method that corrects for depth errors in drillstring measurements using a correction based on stress in the drillstring. U.S. Pat. No. 5,581,024 to Meyer et al., having the same assignee as the present disclosure, addresses the somewhat related problem of correlating measurements made with different sensors on the same bottomhole assembly: due to a non-uniform rate of penetration, measurements made by different sensors take different amounts of time to pass through, for example, a formation having an identifiable thickness. As noted in Meyer, an important prerequisite is downhole depth correlation and vertical resolution matching of all sensor responses. U.S. Pat. No. 6,344,746 to Chunduru et al., having the same assignee as the present disclosure, addresses the problem of joint inversion of time-lapse measurements in which measurements are made at widely spaced intervals using sensors with different resolution. All of these problems could be avoided if accurate estimations could be made of the actual depth of the downhole assembly. See, for example, U.S. Pat. No. 6,769,497 to Dubinsky et al., and U.S. Pat. No. 7,142,985 to Edwards, both having the same assignee as the present disclosure. In the present disclosure, a method of determining depth shifts due to changes in drillstring length using downhole measurements is discussed.

SUMMARY OF THE DISCLOSURE

One embodiment of the disclosure is a method of performing drilling operations. The method includes conveying a bottomhole assembly (BHA) in a borehole on a drillstring, making measurements using a formation evaluation (FE) sensor during rotation of the BHA, producing an image of the formation using the measurements, and estimating, from a change in continuity of a feature in the image, a time when a drillbit loses contact with a bottom of the borehole. Making measurements with the FE sensor further may further include making first measurements with a compressional load on the drillstring, raising the BHA from the bottom of the borehole and reducing the compressional load on the drillstring, making second measurements with (FE) sensor during a subsequent lowering the BHA to the bottom of the borehole and continuing drilling and estimating a stretch of the drillstring using at least one of: (A) the first measurements and the second measurements, and (B) a measurement of a drilling condition.

Another embodiment of the disclosure is an apparatus for performing drilling operations in an earth formation. The apparatus includes a bottomhole assembly (BHA) configured to be conveyed to a bottom of a borehole on a drillstring, a formation evaluation (FE) sensor configured to make measurements of the formation during rotation of the BHA and at least one processor configured to produce an image of the formation using the measurements, and estimate from a change in continuity of a feature in the image a time when a drillbit on the BHA loses contact with a bottom of the borehole. The FE sensor may be further configured to make first measurements with a compressional load on the drillstring and make second measurements when the BHA is raised from the bottom of the borehole and the at least one processor may be further configured to use the first and second measurements to estimate a stretch of the drillstring.

Another embodiment is a computer-readable medium for use with an apparatus for performing drilling operations in an earth formation. The apparatus includes a bottomhole assembly (BHA) configured to be conveyed to a bottom of a borehole on a drillstring and a formation evaluation (FE) sensor configured to make measurements of the formation during rotation of the BHA. The medium includes instructions which enable at least one processor to produce an image of the formation using the measurements, and estimate from a change in continuity of a feature in the image a time when a drillbit on the BHA loses contact with a bottom of the borehole.

BRIEF DESCRIPTION OF THE DRAWINGS

The present disclosure is best understood with the accompanying figures in which like numerals refer to like elements and in which.

DETAILED DESCRIPTION OF THE DISCLOSURE

Figure 1:
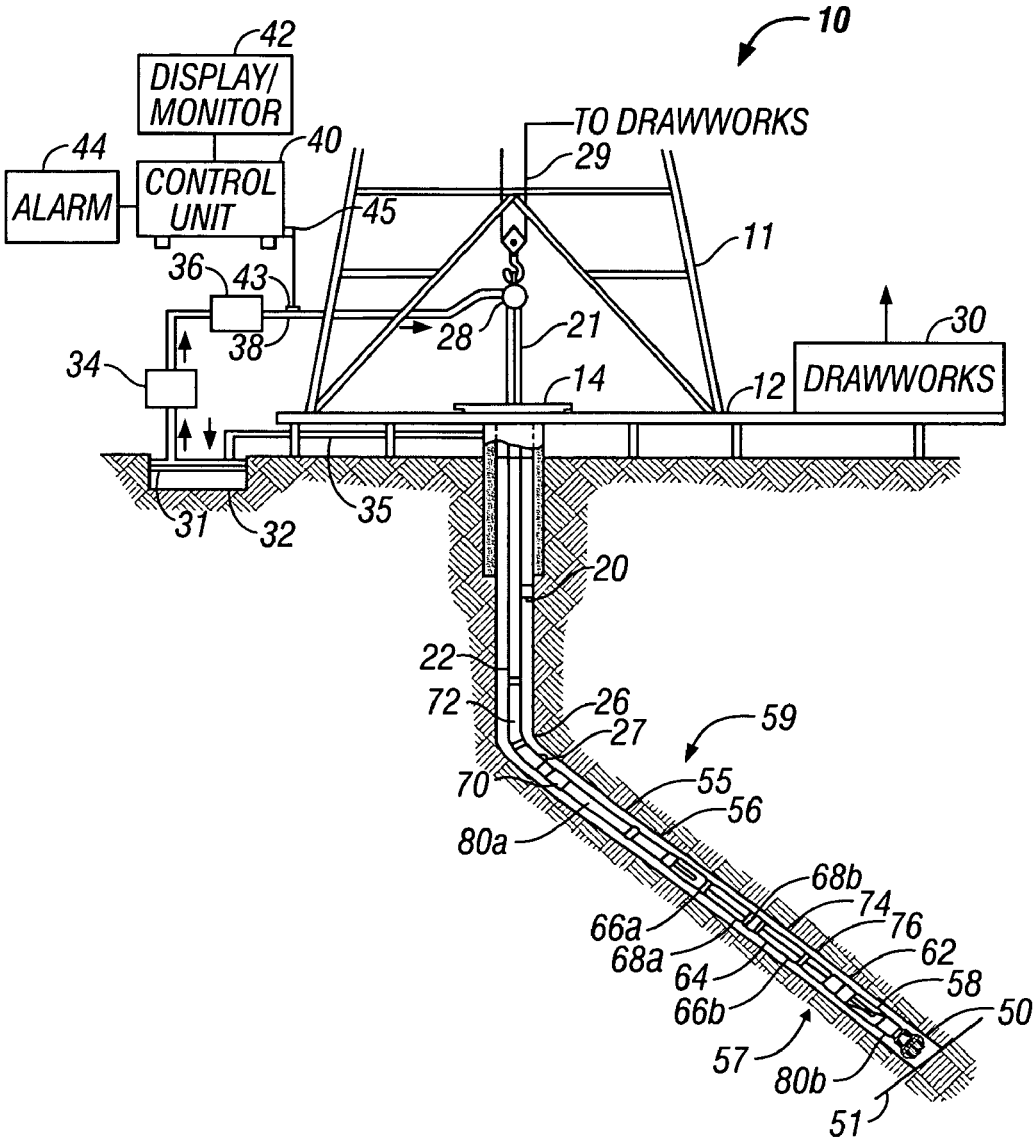
FIG. 1 shows a schematic diagram of a drilling system having downhole sensor systems and surface sensor systems.

FIG. 1 shows a schematic diagram of an exemplary drilling system 10 having surface devices and a downhole assembly containing sensor systems. This is a modification of the device disclosed in U.S. Pat. No. 6,088,294 to Leggett et al. As shown, the system 10 includes a conventional derrick 11 erected on a derrick floor 12 which supports a rotary table 14 that is rotated by a prime mover (not shown) at a desired rotational speed. A drill string 20 that includes a drill pipe section 22 extends downward from the rotary table 14 into a borehole 26. A drill bit 50 attached to the drill string downhole end disintegrates the geological formations when it is rotated. The drill string 20 is coupled to a drawworks 30 via a kelly joint 21, swivel 28 and line 29 through a system of pulleys. During drilling operations, the drawworks 30 is operated to control the weight on bit and the rate of penetration of the drill string 20 into the borehole 26. The operation of the drawworks 30 is well known in the art and is thus not described in detail herein.

During drilling operations a suitable drilling fluid (commonly referred to in the art as "mud") 31 from a mud pit 32 is circulated under pressure through the drill string 20 by a mud pump 34. The drilling fluid 31 passes from the mud pump 34 into the drill string 20 via a desurger 36, fluid line 38 and the kelly joint 21. The drilling fluid is discharged at the borehole bottom 51 through an opening in the drill bit 50. The drilling fluid circulates uphole through the annular space 27 between the drill string 20 and the borehole 26 and is discharged into the mud pit 32 via a return line 35. Preferably, a variety of sensors (not shown) are appropriately deployed on the surface according to known methods in the art to provide information about various drilling-related parameters, such as fluid flow rate, weight on bit, hook load, etc.

A surface control unit 40 receives signals from the downhole sensors and devices via a sensor 43 placed in the fluid line 38 and processes such signals according to programmed instructions provided to the surface control unit. The surface control unit displays desired drilling parameters and other information on a display/monitor 42 which information is used by an operator to control the drilling operations. The surface control unit 40 contains a computer, memory for storing data, data recorder and other peripherals. The surface control unit 40 also includes models and processes data according to programmed instructions and responds to user commands entered through a suitable means, such as a keyboard. The control unit 40 is preferably adapted to activate alarms 44 when certain unsafe or undesirable operating conditions occur.

Optionally, a drill motor or mud motor 80*a* coupled to the drill bit 50 via a drive shaft (not shown) disposed in a bearing assembly 57 rotates the drill bit 50 when the drilling fluid 31 is passed through the mud motor 80*a* under pressure. The bearing assembly 57 supports the radial and axial forces of the drill bit 50, the downthrust of the drill motor 55 and the reactive upward loading from the applied weight-on-bit. A stabilizer 58 coupled to the bearing assembly 57 acts as a centralizer for the lowermost portion of the mud motor assembly.

The downhole subassembly 59 (also referred to as the bottomhole assembly or "BHA"), which contains the various sensors and MWD devices to provide information about the formation and downhole drilling parameters and the mud motor, is coupled between the drill bit 50 and the drill pipe 22. The downhole assembly 59 preferably is modular in construction, in that the various devices are interconnected sections so that the individual sections may be replaced when desired.

Still referring to FIG. 1, the BHA also preferably contains sensors and devices in addition to the above-described sensors. Such devices include a device for measuring the formation resistivity near and/or in front of the drillbit 50, a gamma ray device for measuring the formation gamma ray intensity and devices for determining the inclination and azimuth of the drill string 20. The formation resistivity measuring device 64 is preferably coupled above the lower kick-off subassembly 62 that provides signals, from which resistivity of the formation near or in front of the drill bit 50 is determined. A multiple propagation resistivity device ("MPR") having one or more pairs of transmitting antennae 66*a* and 66*b* spaced from one or more pairs of receiving antennae 68*a* and 68*b* may be used. Magnetic dipoles are employed which operate in the medium frequency and lower high frequency spectrum. In operation, the transmitted electromagnetic waves are perturbed as they propagate through the formation surrounding the resistivity device 64. The receiving antennae 68*a* and 68*b* detect the perturbed waves. Formation resistivity is derived from the phase and amplitude of the detected signals. The detected signals are processed by a downhole circuit that is preferably placed in a housing above the mud motor 55 and transmitted to the surface control unit 40 using a suitable telemetry system 72. It should be noted that the MPR is for exemplary purposes only and other propagation resistivity sensor may be used.

The inclinometer 74 and gamma ray device 76 are suitably placed along the resistivity measuring device 64 for respectively determining the inclination of the portion of the drill string near the drill bit 50 and the formation gamma ray intensity. Any suitable inclinometer and gamma ray device, however, may be utilized for the purposes of this disclosure. In addition, an azimuth device (not shown), such as a magnetometer or a gyroscopic device, may be used to determine the drill string azimuth. Such devices are known in the art and are, thus, not described in detail herein. In the above-described configuration, the mud motor 55 transfers power to the drill bit 50 via one or more hollow shafts that run through the resistivity measuring device 64. The hollow shaft enables the drilling fluid to pass from the mud motor 55 to the drill bit 50. In an alternate embodiment of the drill string 20, the mud motor 55 may be coupled below resistivity measuring device 64 or at any other suitable place.

The drill string 20 contains a modular sensor assembly, a motor assembly and kick-off subs. In a preferred embodiment, the sensor assembly includes a resistivity device, gamma ray device and inclinometer, all of which are in a common housing between the drill bit and the mud motor. Such prior art sensor assemblies would be known to those versed in the art and are not discussed further.

The downhole assembly of the present disclosure may include a MWD section which contains a nuclear formation porosity measuring device, a nuclear density device and an acoustic sensor system placed above the mud motor 55 for providing information useful for evaluating and testing subsurface formations along borehole 26. The present disclosure may utilize any of the known formation density devices. Any prior art density device using a gamma ray source may be used. In use, gamma rays emitted from the source enter the formation where they interact with the formation and attenuate. The attenuation of the gamma rays is measured by a suitable detector from which density of the formation is determined.

Figure 2:
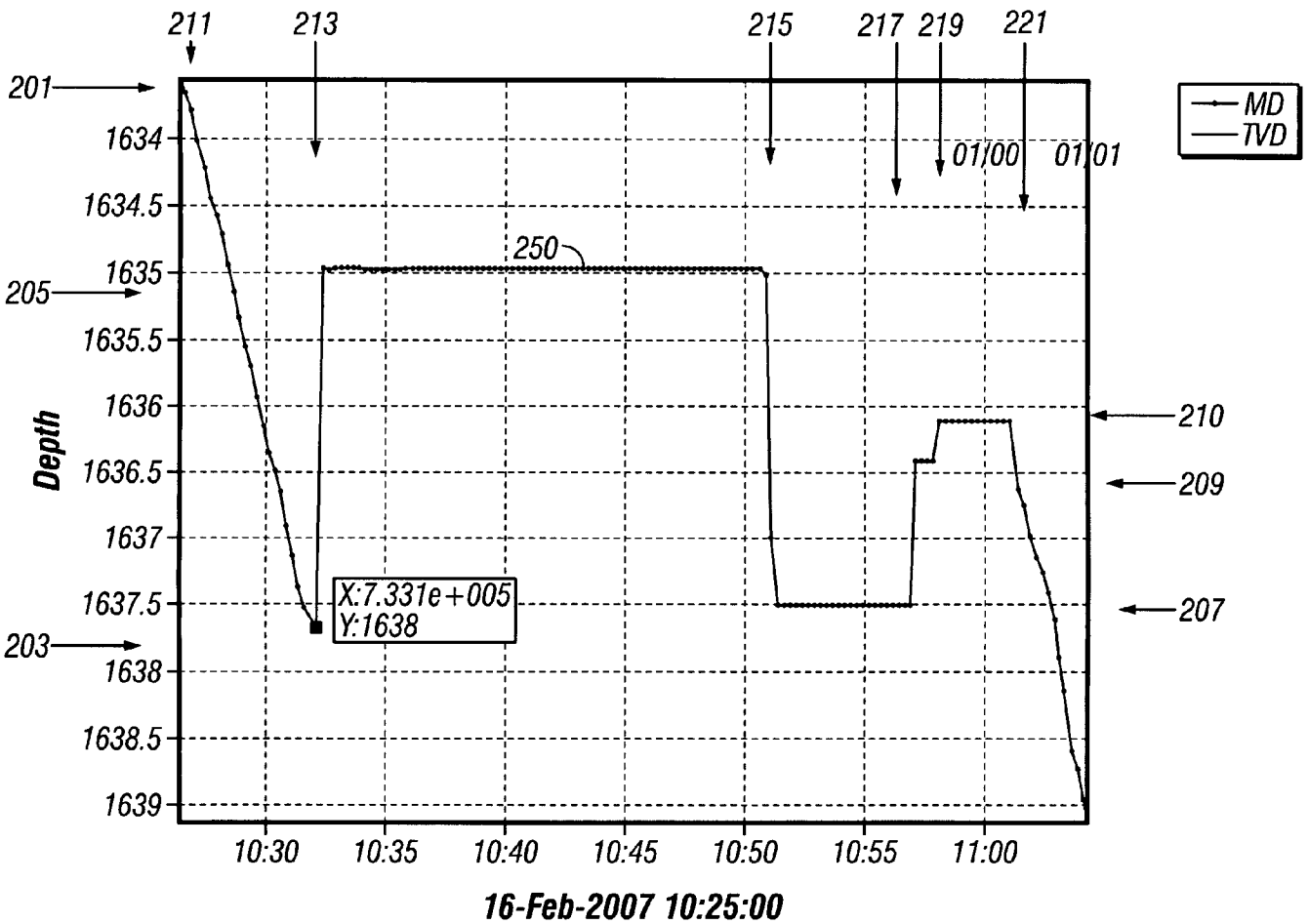
FIG. 2 illustrates an exemplary time-depth curve in drilling operations based on measurements of time and depth of the surface sensor systems.

FIG. 2 illustrates an exemplary time-depth curve in drilling operations. The abscissa is the time with a defined reference, such as the time of the day or the time since drilling was started on this particular trip. The ordinate is the drilling depth as determined from surface measurements. In this particular example, the curve 250 represents the drilling depth. At the time indicated by 211, the measured drilling depth is 201. Drilling continues until the time 213 where the measured depth is 203. At the time indicated by 213, the drillbit is raised off the bottom of the borehole to depth 205 where it stays until the time 215. At the time 215, the drillbit is again lowered to the bottom of the hole at depth 207 and kept there until time 217. At time 217, the drillbit is again raised, after a brief intermediate pause, to the depth 210 at time 219. At time 221, the drillbit is lowered again at a speed indicated by the slope of the drilling curve. Those versed in the art would recognize that without knowledge of the rotational speed of the drillbit, it is not possible to determine the actual operation being performed (e.g., drilling, reaming, circulating etc.)

Figure 3:
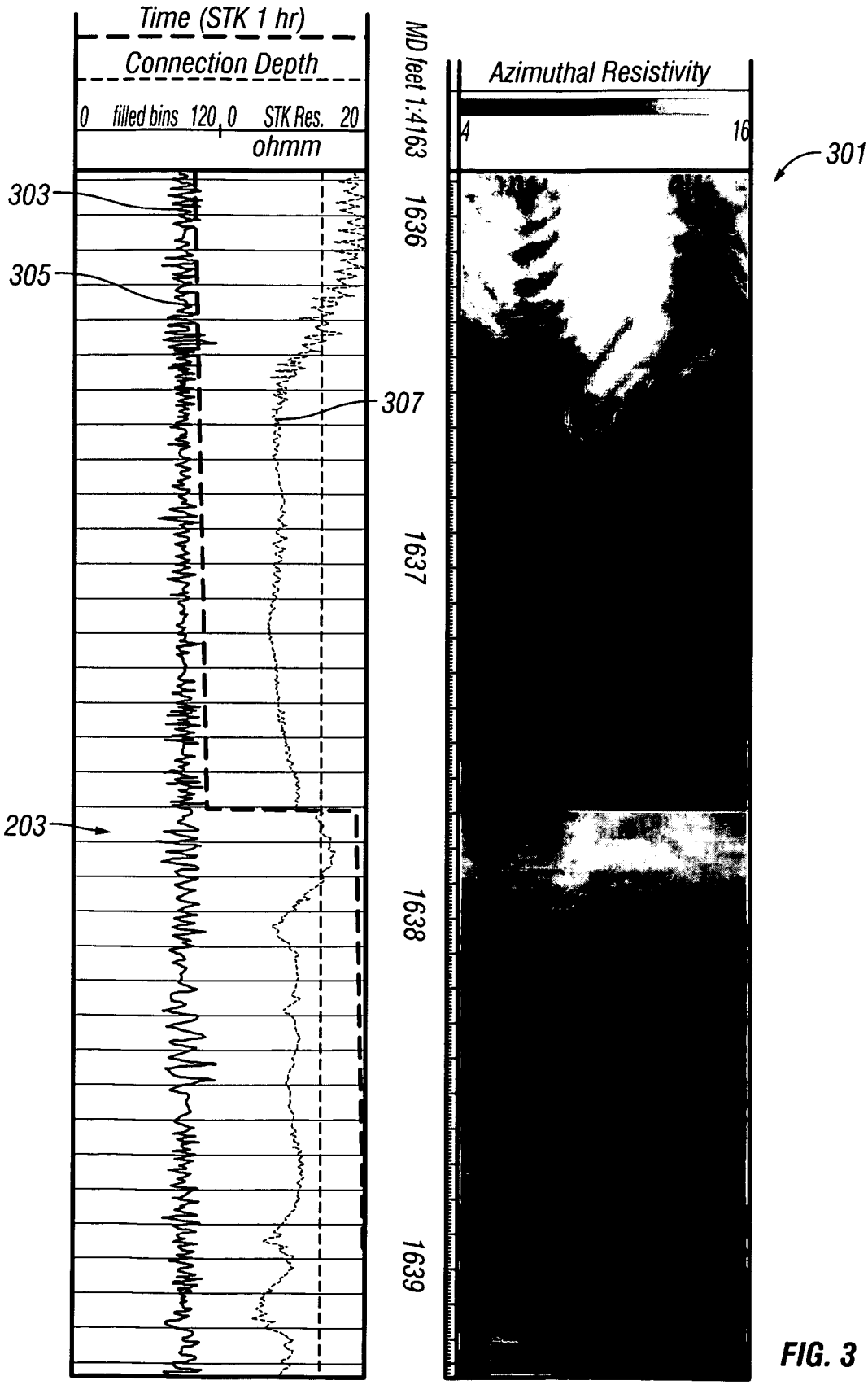
FIG. 3 shows a resistivity image as a function of depth for measurements made while drilling.

FIG. 3 shows, on the right side, a resistivity image 301 in depth obtained by processing measurements made by a resistivity sensor on the BHA while drilling. As is standard practice, an orientation sensor such as a magnetometer is used to make azimuthal orientation measurements of the BHA during rotation. The method described in U.S. Pat. No. 7,195,062 to Cairns et al., having the same assignee as the present disclosure, may be used. As discussed there, Cairns teaches a measurement-while-drilling (MWD) downhole assembly for use in drilling boreholes which utilizes directional formation evaluation devices on a rotating assembly in conjunction with toolface orientation sensors. The data from the toolface orientation sensors are analyzed by a processor and toolface angle measurements are determined at defined time-intervals. Formation evaluation sensors operate substantially independently of the toolface orientation sensors and measurements of the formation evaluation sensors are analyzed in combination with the determined toolface angle to obtain formation parameters. In typical fashion, the image is displayed with the circular borehole unwrapped onto a flat plane. The resistivity image was obtained with the BHA rotating at the speed indicated by 303. This speed is indicated in rpm. The curve 305 is a portion of the time curve 250 in FIG. 2. At the depth indicated by 203 (1637.7 ft) and the time indicated by 213 the drillbit was raised. This raising of the drillbit may be done using the drawworks. This is clearly seen in the sharp break in the resistivity image at this depth. While the drilling is going on ("making hole"), the drillstring would be under axial compression. When the drillbit is raised, the axial compression of the drillstring drops to zero and may change to an axial tension due to the weight of the drillstring. Consequently, the length of the drillstring will change.

Figure 4:
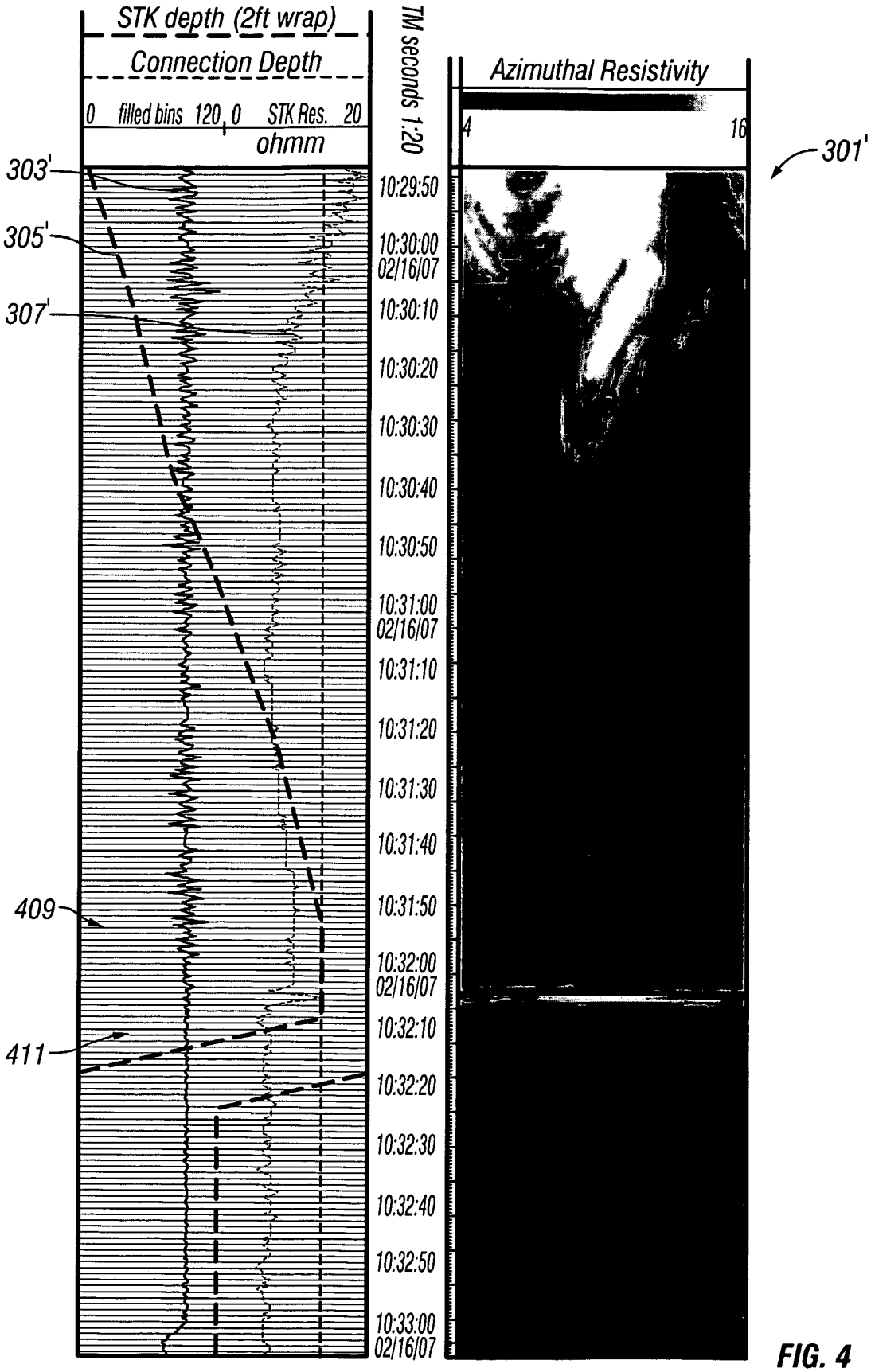
FIG. 4 shows the resistivity image as a function of time while drilling, during picking up off-bottom of the BHA and while rotating off-bottom with the drilling part corresponding to the upper portion of the depth image of FIG. 3.

FIG. 4 shows, on the right hand side, the resistivity image 301' in time corresponding to the depth image 301. At 10:31:42 409 the driller puts on the brakes and lets the bit drill off, at 10:32:02 411 he picks up the bit off bottom. The timing can be inferred from the RPM curve 303'. It can also be inferred from the image as features become drawn out when the drill off starts and features become discontinuous and squeezed when the bit is picked up and features remain constant when the BHA is rotated off-bottom at a constant depth. The curve 305' represents depth measured by the surface sensors and indicates drill-off and pick up at 10:31:51 and 10:32:07.

Figure 5:
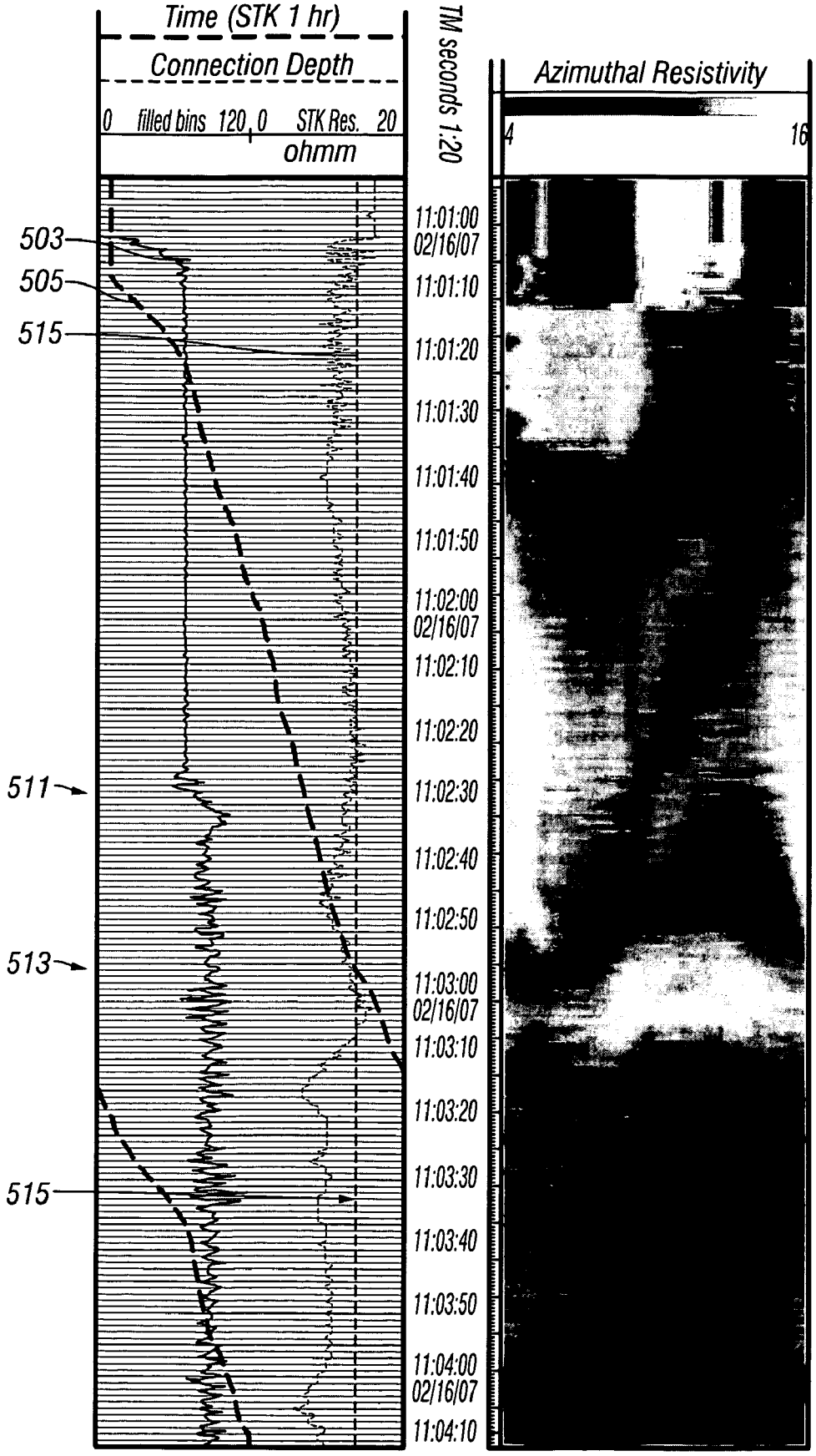
FIG. 5 shows a resistivity image as a function of time when a drillstring is lowered back to the bottom of the borehole and drilling is resumed with the drilling part corresponding to the lower portion of the depth image of FIG. 3.

FIG. 5 shows the image acquired before going back on bottom and resuming drilling. Prior to 11:02:25 511, the drillbit is reentering a previously drilled section, so that the RPM curve 503 is steady. Over this interval, the weight on bit (WOB) would be small as little force is needed to go through a previously drilled section. At 511 the bit goes back on-bottom, visible from the image and the noisy RPM curve 503, an indication that drilling has resumed. Concurrently, the WOB and the torque would increase (not shown).

From the surface depth-tracking system the bit reaches the bottom at 11:02:55 513 (depth curve 505 crosses the line indicating the connection depth at 513). A simple explanation of this difference between 511 and 513 is that when the drillstring is lifted off the bottom, the drillstring extends in length. On the subsequent lowering, the extended drillstring makes contact with the bottom of the borehole earlier than with the compressed drillstring (which reached the bottom of the hole initially). The discrepancy of 30 seconds leads to the artifacts in the image that are visible in FIG. 3, 203 as a discontinuity in the image.

Figure 6:
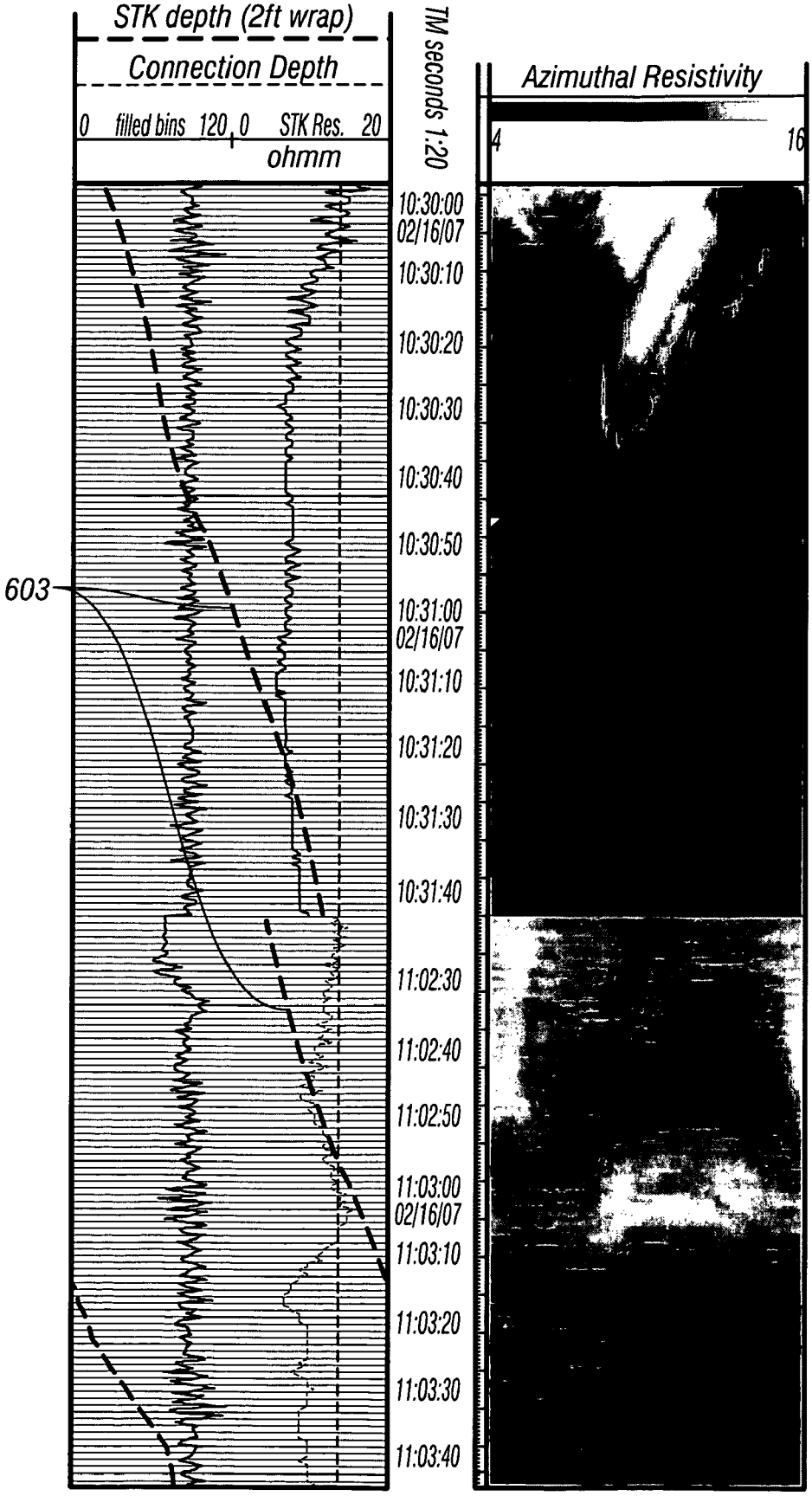
FIG. 6 shows a time-based image obtained by combining the images of FIGS. 4 and 5.

FIG. 6 shows a time-based image where the two images (from FIGS. 4 & 5) have been joined at the times inferred from the image itself. The discontinuity in the depth curve 603 is the difference between stretched and compressed pipe length. The discrepancy in depth can be determined by any one of several methods. In the first method, the images recorded in the overlap section can be correlated. In the second method, monitoring the noise level in the RPM upon resuming drilling operations provides an indication when the bit makes contact with the bottom of the previously drilled hole. In the third method changes of continuity of features in the image are used to determine points of time when the bit makes of looses contact to the bottom hole. A comparison between the surface measured depth at this point and the previously measured surface-measured depth to the bottomhole gives the drillstring stretch. A similar result can be obtained by monitoring the weight on bit and the torque. Collectively, we may refer to the RPM, weight-on-bit and torque as measurements of drilling conditions.

Figures 7A, 7B:
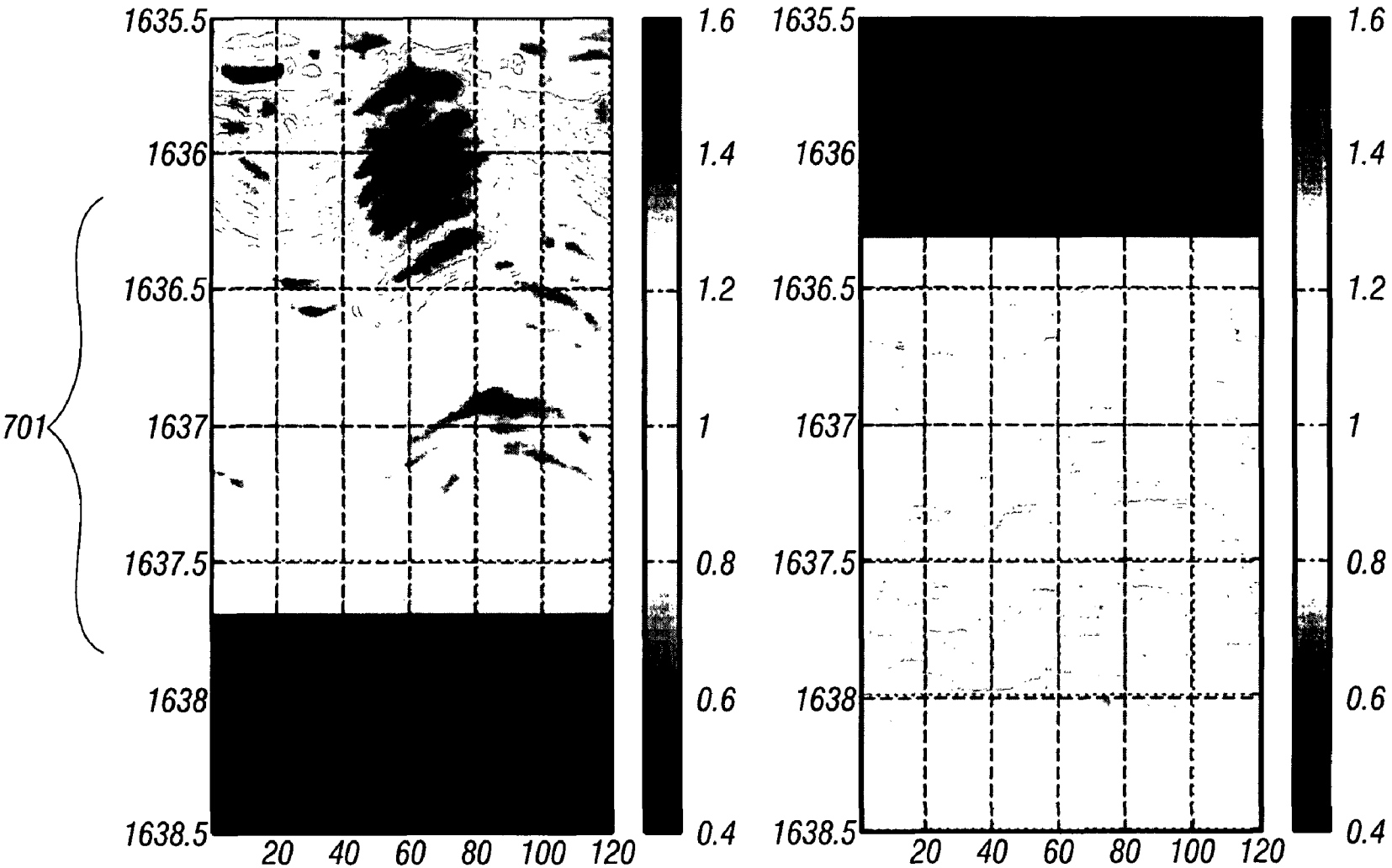
FIGS. 7A and 7B show the two depth images acquired at different times corrected for misalignment.

FIGS. 7A and 7B show the resistivity images obtained in the two drilling phases respectively after the depth correction has been applied. The similarities in the overlap section show that the depth correction is accurate.

It should be noted that while the description above has been with respect to a resistivity image, the method could also be used with other types of images, such as acoustic images, density images, porosity images, images of the dielectric constant, as long as an appropriate formation evaluation sensor is used to make the measurements. The processing of the data may be done downhole using a downhole processor or at the surface with a surface processor. It is also possible to store at least a part of the data downhole in a suitable memory device, in a compressed form if necessary. Upon subsequent retrieval of the memory device during tripping of the drillstring, the data may then be retrieved from the memory device and processed uphole.

Implicit in the processing of the data is the use of a computer program on a suitable machine-readable medium that enables the processor to perform the control and processing. The machine-readable medium may include ROMs, EPROMs, EEPROMs, Flash Memories and Optical disks While the foregoing disclosure is directed to the preferred embodiments of the disclosure, various modifications will be apparent to those skilled in the art. It is intended that all variations within the scope and spirit of the appended claims be embraced by the foregoing disclosure.

What is claimed is:

1. A method of performing drilling operations, the method comprising:

using a drillstring for conveying a bottomhole assembly (BHA) into a borehole;

making first measurements with a compressional load on the BHA;

making second measurements without a compressional load on the drillstring;

using a processor for estimating, from the first measurements and the second measurements, a parameter related to a change between the loaded and unloaded condition of the BHA the parameter being selected from: (i) a time when a drillbit loses contact with a bottom of the borehole, (ii) a time when a drillbit makes contact with a bottom of the borehole, and (iii) a stretch of the drillstring; and continuing further drilling operations based on the parameter;

wherein the first measurements and the second measurements comprise a formation evaluation measurement made at a plurality of toolface angles.

2. The method of claim 1 wherein the first measurements and the second measurements further comprise at least one of: (i) a resistivity measurement, (ii) an acoustic measurement, (iii) a density measurement, (iv) a porosity measurement, (v) a gamma ray measurement, and (vi) a measurement of a dielectric constant.

3. The method of claim 1 wherein estimating the parameter related to the change between the loaded and unloaded condition further comprises estimating a time of transition between the loaded and unloaded condition using a first two-dimensional image produced from the first measurements and a second two-dimensional image produced using the second measurements.

4. The method of claim 1 wherein estimating the parameter related to the change between the loaded and unloaded condition further comprises estimating a time of transition between the loaded and unloaded condition using at least one of: (i) a weight-on-bit measurement, (ii) a measurement of rotational speed.

5. The method of claim 3 wherein using the first two dimensional image and the second two-dimensional image further comprises correlating the first two dimensional image and the second two-dimensional image.

6. The method of claim 5 wherein producing the first two-dimensional image further comprises using orientation measurements made by an orientation sensor.

7. The method of claim 1 wherein estimating the parameter related to the change between the loaded and unloaded condition further comprises estimating a stretch of a drillstring used to convey the BHA by:

using a difference between a first surface measured depth and a surface measured depth of the bottom of the borehole.

8. The method of claim 1 further comprising correcting measurements made with a formation evaluation sensor for stretch of drillstring conveying the BHA.

9. An apparatus for performing drilling operations, the apparatus comprising:

a bottomhole assembly (BHA) configured to be conveyed in a borehole on a drillstring;

at least one sensor on the BHA configured to make first measurements at a plurality of toolface angles of the BHA with a compressional load on the BHA and make second measurements at a plurality of toolface angles of the BHA without a compressional load on the drillstring; and a processor configured to estimate, from the first measurements and the second measurements, a parameter related to a change between the loaded and unloaded condition of the BHA;

the parameter being selected from: (i) a time when a drillbit loses contact with a bottom of the borehole, (ii) a time when a drillbit makes contact with a bottom of the borehole, and (iii) a stretch of the drillstring.

10. The apparatus of claim 9 wherein the at least one sensor is selected from the group consisting of: (i) a resistivity sensor, (ii) an acoustic sensor, (iii) a density sensor, (iv) a porosity sensor, (v) a gamma ray sensor, and (vi) a sensor of a dielectric constant.

11. The apparatus of claim 9 wherein the parameter related to the change between the loaded and unloaded condition further comprises a time of transition between the loaded and unloaded condition and wherein the processor is configured to estimate the time of transition using a first two-dimensional image produced from the first measurements and a second two-dimensional image produced using the second measurements.

12. The apparatus of claim 9 wherein the parameter related to the change between the loaded and unloaded condition further comprises a time of transition between the loaded and unloaded condition and wherein the processor is configured to estimate the time of transition using at least one of: (i) a weight-on-bit measurement, (ii) a measurement of rotational speed.

13. The apparatus of claim 11 wherein the processor is further configured to use the first image and the second image by correlating the first image and the second image.

14. The apparatus of claim 13 wherein the processor is further configured to produce the first two-dimensional image by further using orientation measurements made by an orientation sensor.

15. The apparatus of claim 9 wherein the parameter related to the change between the loaded and unloaded condition further comprises a stretch of the drillstring and wherein the processor is further configured to estimate the stretch by:

using a difference between a first surface measured depth and a surface measured depth of the bottom of the borehole.

16. The apparatus of claim 9 wherein the processor is further configured to correct measurements made with a formation evaluation sensor for stretch of drillstring conveying the BHA.

17. A computer-readable medium product having stored thereon instructions that when read by at least one processor cause the at least one processor to perform a method, the method comprising:

estimating, from first measurements made with a compressional load on a bottomhole assembly (BHA) conveyed in a borehole and second measurements made without a compressional load on the BHA, a parameter related to a change between the loaded and unloaded condition of the BHA, the parameter being selected from: (i) a time when a drillbit loses contact with a bottom of the borehole, (ii) a time when a drillbit makes contact with a bottom of the borehole, and (iii) a stretch of the drillstring; and continuing further drilling operations based on the parameter;

wherein the first measurements and the second measurements comprise a formation evaluation measurement made at a plurality of toolface angles.

18. The medium of claim 17 further comprising at least one of:

(i) a ROM, (ii) an EPROM, (iii) an EEPROM, (iv) a flash memory, and (v) an optical disk.

* * * * *